United States Patent [19]

Widmer

[11] Patent Number: 4,674,272

[45] Date of Patent: Jun. 23, 1987

[54] DEVICE FOR RADIALLY MOVABLY MOUNTING A SPINNING OR TWISTING SPINDLE

[75] Inventor: Dieter Widmer, Stäfa, Switzerland

[73] Assignee: Spindel Motoren & Maschinenfabrik AG, Uster, Switzerland

[21] Appl. No.: 885,670

[22] Filed: Jul. 15, 1986

[30] Foreign Application Priority Data

Jul. 24, 1985 [CH] Switzerland ..... 3201/85

[51] Int. Cl.[4] ..... D01H 7/12

[52] U.S. Cl. ..... 57/135; 57/130; 57/134; 248/560; 248/603; 248/605; 248/610; 384/230; 384/231

[58] Field of Search ..... 57/129-135; 384/226-241; 248/560, 603, 580-582, 605-607, 610-613, 637, 644, 674, 675

[56] References Cited

U.S. PATENT DOCUMENTS

| | | | |
|---|---|---|---|
| 1,774,666 | 9/1930 | Rabert | 57/135 X |
| 2,609,254 | 9/1952 | Harris | 57/135 X |
| 3,438,191 | 4/1969 | Kuznetsov et al. | 57/135 |
| 3,462,937 | 8/1969 | Schmid | 384/231 X |
| 3,500,624 | 3/1970 | Polyakovsky et al. | 57/129 |
| 3,510,181 | 5/1970 | Stahlecker | 384/231 |
| 3,641,759 | 2/1972 | Kohler | 57/129 |
| 3,695,024 | 10/1972 | Tsunoda | 57/130 |
| 3,920,291 | 11/1975 | Wendel et al. | 384/230 |

FOREIGN PATENT DOCUMENTS

| | | |
|---|---|---|
| 1685971 | 10/1971 | Fed. Rep. of Germany . |
| 2211488 | 9/1972 | Fed. Rep. of Germany . |
| 509430 | 6/1971 | Switzerland . |
| 528028 | 9/1972 | Switzerland . |

*Primary Examiner*—John Petrakes

*Attorney, Agent, or Firm*—Werner W. Kleeman

[57] ABSTRACT

A resilient element connects the housing of the spindle collar bearing with the spindle rail and contains a circumferential arrangement of resiliently flexible rods surrounding with play the housing of the spindle collar bearing in a substantially parallel relationship thereto. The resiliently flexible rods which are arranged at substantially uniform circumferential spacing from one another extend at both of their ends from an associated common retaining sleeve for the related rod ends. One such retaining sleeve is anchored at the spindle rail. The other retaining sleeve is fixedly anchored at the housing of the spindle collar bearing in a region or at a location spaced from a housing side at which the spindle exits from such housing. The resilient element forms a spatial parallelogram permitting only radial movement of the housing against the spring action of the resiliently flexible rods without inclined positioning of the housing.

13 Claims, 4 Drawing Figures

DEVICE FOR RADIALLY MOVABLY MOUNTING A SPINNING OR TWISTING SPINDLE

BACKGROUND OF THE INVENTION

The present invention relates to a new and improved construction of a device for radially movably mounting at the spindle rail of a textile machine, particularly a spinning or twisting machine, a housing of the spindle collar bearing of a spindle, particularly a spinning or twisting spindle.

In its more particular aspects the present invention specifically relates to a new and improved construction of a device for radially movably mounting at the spindle rail of a spinning or twisting machine a housing of the spindle collar bearing of a spinning or twisting spindle and which device contains a resilient element which is mounted at the spindle rail as well as at the housing for the spindle collar bearing.

In a device as known, for example, from Swiss Pat. No. 509,430, granted June 30, 1971, the resilient or elastic element constitutes a substantially annular laminated spring having an elastomeric spring body. This laminated spring surrounds with play the housing of the spindle collar bearing. The laminated spring is clamped between a plate, which is anchored at the top side of the spindle rail and surrounds with play the housing of the spindle collar bearing, and an annular flanged sleeve bolted to the housing of the spindle collar bearing. The housing of the spindle collar bearing traverses with play a bore formed in the spindle rail and contains a housing portion which is located below the spindle rail and which is provided with an external thread. A nut is provided with a shoulder and is threadably connected with the external thread of the housing portion.

A compression spring surrounds the housing of the spindle collar bearing. One end of the compression spring is supported at the shoulder of the nut which is threadably connected with the external thread of the housing portion. An other end of the compression spring is supported either at the bottom side of the aforementioned plate or at the spindle rail as such.

The compression spring is intended to precompress the laminated spring substantially in axial direction and thus to impede, in an adjustable manner, the axial movability of the housing of the spindle collar bearing more strongly than its radial movability. A belt-driven wharve or whirl is seated at the spindle which, in turn, is journaled in bearings arranged within the housing of the spindle collar bearing. When such belt-driven wharve or whirl is subjected to the unilaterally acting pulling or tension force of a driving belt, the laminated spring is additionally and unilaterally pressure loaded. As a result, the whole housing of the spindle collar bearing assumes an oblique or inclined position relative to the spindle rail. This is undesirable at least at supercritical rotational driving speeds of the spindle and in consideration of the unavoidable imbalances of the yarn package seated on the spindle.

Similar considerations apply to the mounting of the housing of the spindle collar bearing according to German Patent Publication No. 1,685,971, published Oct. 14, 1971. When in this construction the fixed mounting at the spindle rail is released, which fixed mounting is suitable at low rotational speeds, and the elastic insert is rendered active, the spindle is intended to be driven at higher rotational speeds. In this construction the resilient element, which also constitutes an elastomer, substantially has the shape of a thick-walled hollow, upwardly diverging truncated cone. The outer conical surface of this resilient element in the shape of a truncated cone is directly vulcanized to the complementary shaped inner side of an annular element bolted to the spindle rail. The inner conical surface of the resilient element in the shape of the truncated cone is vulcanized to a complementary shaped outer side of a sleeve which is clamped to the housing of the spindle collar bearing. Also in this construction the pulling or tension force exerted by the belt upon the wharve or whirl unavoidably causes an oblique or inclined position of the housing of the spindle collar bearing and this undesirable position can only be eliminated when such housing is again fixedly clamped to the spindle rail. This, however, leads to undesirable vibrations of the spindle rail during operation at supercritical rotational speeds.

The foregoing discussion of the device according to Swiss Pat. No. 509,430 substantially applies also to the textile spindle support disclosed in the German Patent Publication No. 2,211,488, published Sept. 21, 1972. In this prior art construction a triangular top plate is bolted to the housing of the spindle collar bearing and a similarly shaped bottom plate is fixedly bolted to the spindle rail. The housing of the spindle collar bearing traverses with play a central opening in the bottom plate. Both plates are interconnected at their corners by means of bolts and nuts, and rubber bushings are interposed therebetween. Also in this construction the pulling or tension force exerted by the belt upon the wharve or whirl causes an inclination of the top plate and thus of the housing of the spindle collar bearing. Contributing to such inclination is not only the non-uniform pressure load on the rubber bushings and which non-uniform pressure load originates from the pull of the belt, but possibly also an elastic doming or bulging of the relatively thin top plate.

There is still further to be mentioned the bearing device according to Swiss Pat. No. 528,028, granted Sept. 15, 1972, and as far as this construction is concerned there basically applies substantially the same comments as were previously made with regard to the construction according to the aforementioned Swiss Pat. No. 509,430. The essential difference between the two bearing devices is that the resilient element according to Swiss Pat. No. 528,028 does not constitute a laminated spring but a rubber ring which is disposed below the spindle rail. A flat bottom side of this rubber ring bears upon a top side of a lower end flange of a sleeve which is fixedly clamped to the spindle rail. A flat top side of the rubber ring bears upon an inwardly projecting end flange of a further housing member which is threadably connected to the housing of the spindle collar bearing and extends over the rubber ring.

SUMMARY OF THE INVENTION

Therefore, with the foregoing in mind, it is a primary object of the present invention to provide a new and improved construction of a device for radially movably mounting at the spindle rail of a textile machine, particularly a spinning or twisting machine a housing of the spindle collar bearing of a spindle, particularly a spinning or twisting spindle and which device does not exhibit the aforementioned drawbacks and shortcomings of the prior art constructions.

Another and more specific object of the present invention is directed to the provision of a new and improved construction of a device for radially movably mounting at the spindle rail of a spinning or twisting machine, a housing of the spindle collar bearing of a spinning or twisting spindle such that there is permitted for the housing of the spindle collar bearing substantially only the possibility of radial excursion or movement, however, without practically any inclination being experienced by the axis of the housing of the spindle collar bearing during such permissible radial excursion.

Now in order to implement these and still further objects of the present invention, which will become more readily apparent as the description proceeds, the device of the present development is manifested by the features that the resilent element contains resilent flexible rods which substantially circumferentially surround with play at least part of the housing of the spindle collar bearing in a substantially parallel relationship to such housing and which rods are arranged at substantially uniform or equidistant circumferential spacing from one another. The resiliently flexible rods extend at both their ends from an associated common retaining sleeve for the related rod ends. One of the retaining sleeves is anchored at the spindle rail. The other one of the retaining sleeves is fixedly anchored at the housing of the spindle collar bearing in a region or location spaced from a housing side at which the spinning or twisting spindle exits or departs from such housing.

The circumferentially arranged resiliently flexible rods together with their retaining sleeves conjointly form a type of spatial parallelogram permitting displacement or excursion of the other retaining sleeve practically only perpendicular to the axis of the resiliently flexible rods. Since, however, this other retaining sleeve is fixedly connected with the housing of the spindle collar bearing, such housing can be deflected only radially against the action of the resiliently flexible rods and substantially without any inclination.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
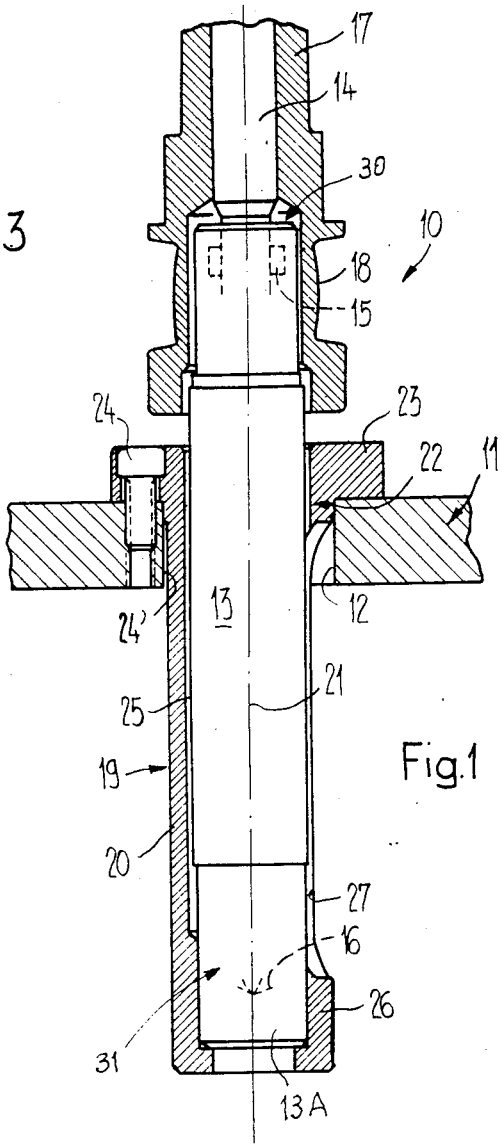
FIG. 1 is a longitudinal section taken substantially along line I—I in FIG. 3 and shows an exemplary embodiment of the inventive device with an unsectioned view of the housing of the spindle collar bearing.

Describing now the drawings, it is to be understood that to simplify the showing thereof only enough of the construction of the device has been illustrated therein as is needed to enable one skilled in the art to readily understand the underlying principles and concepts of the present invention. Turning attention now specifically to FIG. 1 of the drawings, there is shown therein an exemplary embodiment of the inventive device 10 for radially movably mounting at a spindle rail of a textile machine, particularly a spinning or twisting machine the housing of a spindle collar bearing of a spindle, particularly a spinning or twisting spindle. There is recognized in FIG. 1 a portion of a support, here a portion of the spindle rail 11 which constitutes a component of the spinning or twisting machine containing a plurality of identical spindles. The spindle rail 11 has a through-going or open-ended bore 12 for each such spindle. The spindle includes a housing 13 of the conventional spindle collar bearing and a conventional bearing bushing (not shown) is arranged in such housing 13. A spindle shaft 14 extends into this bearing bushing or bush. Generally the spindle shaft 14 is rotatably supported in the bearing bushing or bush by means of a collar bearing 15 and a foot bearing 16 which is only indicated by broken lines in FIG. 1, such that the spindle shaft 14 can carry out, in addition to its rotary movement, wobbling movements about a center which is located substantially at the level of the collar bearing 15. Such wobbling movements occur against the action of a suitable centering damping device (not shown) which is also accommodated in the housing 13 of the spindle collar bearing.

Figure 3:
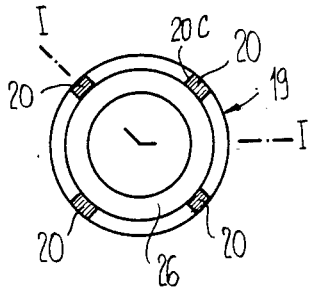
FIG. 3 is a section through the resilient element taken substantially along the line III—III in FIG. 2.

A portion of the spindle shaft 14 extends outwardly or protrudes from the housing 13 of the spindle collar bearing at a predetermined location or housing side 30 and a bobbin mandrel 17 is seated on this protruding portion of the spindle shaft 14. The bobbin mandrel 17 contains a drive wharve or whirl 18 which is formed at the bobbin mandrel 17 and surrounds the upper end of the housing 13 of the spindle collar bearing. The housing 13 of the spindle collar bearing is mounted at the spindle rail 11 only by means of the resilient element generally designated by the reference character 19. In the illustrated embodiment, this resilient element 19 is constructed for mounting at the spindle rail 11 and at the housing 13 of the spindle collar bearing and possesses a circumferential arrangement of at least four resiliently flexible rods or bars 20 extending in their unbent or non-deflected state substantially parallel to an axis 21 of the housing 13 of the spindle collar bearing. The resiliently flexible rods or bars 20 are arranged at uniform or equal angular or circumferential mutual spacing. The resiliently flexible rods or bars 20 may be of substantially quadrangle, especially rectangular cross-section as shown in FIG. 3, and their narrow sides 20C are substantially radially directed. At their top ends 20A the resiliently flexible rods or bars 20 extend from one common retaining sleeve 22 which has a flange 23 bolted to the top side or face of the spindle rail 11 by means of bolts 24 or equivalent fastening expedients. The resiliently flexible rods or bars 20 further extend downwardly with radial play or clearance relative to the inner wall of the through-going or open-ended bore 12 in the spindle rail 11 as indicated by the gap 24', as well as relative to the outer wall of the housing 13 of the spindle collar bearing as indicated by the predetermined clearance or gap 25. The resiliently flexible rods or bars 20 then merge at their lower ends 20B with another common retaining sleeve 26 in which a lower end 13A of the housing 13 of the spindle collar bearing is fixedly seated by a press fit, if desired, with the assistance of further mounting means, for example, a suitable bonding agent. The resilient element 19 thus contains the retaining sleeves 22 and 26 at its opposite ends 19A and 19B.

As illustrated in the drawings, the resiliently flexible rods or bars 20 and the retaining sleeves 22 and 26 are here made in one piece by way of example and also can be formed, for instance, from any suitable metallic material. The resiliently flexible rods or bars 20 have increasing cross-sections and thus increasing strength in related transition regions which extend toward the common retaining sleeves 22 and 26 at the associated rod ends 20A and 20B. Due to this construction, the other or lower retaining sleeve 26 which is fixedly connected with the housing 13 of the spindle collar bearing, can be displaced transversely or radially with respect to the axis 21, however, such retaining sleeve 26 is not tilted under any circumstances because the flexibly resilient rods or bars 20 can only be bent, whereas their elongation, if any, is negligible as compared to the extent of their bending or deflection. The extent to which the housing 13 of the spindle collar bearing can be displaced radially and parallel to itself is essentially determined by the width of the predetermined clearance or gap 25.

Figure 2:
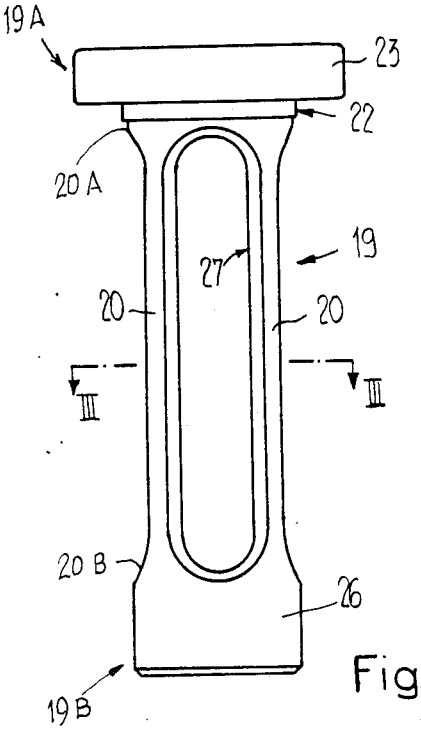
FIG. 2 is a view of the resilent element in the device shown in FIG. 1.

It can also be recognized from FIG. 2 that the one-piece resilient element 19 can be easily manufactured. This may be done by means of a material removal or machining operation during which oblong or elongated oval apertures or intermediate spaces 27 are milled or otherwise appropriately cut machined into a tubularly shaped starting blank or part. Alternatively, the resilient element 19 can be manufactured as a diecasting using an alloy which has sufficient elastic properties insuring the small permitted bending or deflections or excursions of the resiliently flexible rods or bars 20.

Figure 4:
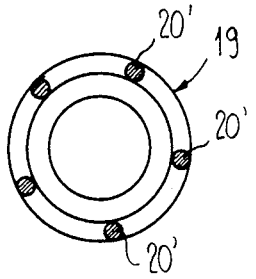
FIG. 4 is a section similar to the section in FIG. 3 and shows a modification of the resilent element shown in FIGS. 2 and 3.

FIG. 4 shows a modification of the resilient element 19 which has five resiliently flexible rods or bars 20' of substantially round cross-section.

The resilient element 19 need not be formed in one piece. There also can be used resiliently flexible rods or bars which are made of, for example, glass fiber-reinforced plastic material and which are anchored with both of their ends in separate common retaining sleeves. Also, it is not required that the retaining sleeve 22 be mounted at the top side of the spindle rail 11.

It is a further advantage of the inventive device described hereinbefore that such device also can be installed or retrofitted in existing spinning or twisting machines without any extensive conversion or constructional modifications because the device does not require any particular shaping or structuring at either the housing 13 of the spindle collar bearing or at the spindle rail 11. Moreover, the inventive device is resistant to aging contrary to those bearing mounts possessing a rubber-containing spring or damping element.

While there are shown and described present preferred embodiments of the invention, it is to be distinctly understood that the invention is not limited thereto, but may be otherwise variously embodied and practiced within the scope of the following claims.

Accordingly, what I claim is:

1. A device for radially movably mounting at a spindle rail of a textile machine, particularly a spinning or twisting machine, a housing of a spindle collar bearing of a spindle, particularly a spinning or twisting spindle which exits at a predetermined housing side from such housing, said device comprising:

a resilient element structured for mounting at said spindle rail and at said housing of the spindle collar bearing;

said resilient element having two ends;

said resilient element containing a retaining sleeve at each one of its two ends;

said resilient element further containing a plurality of resiliently flexible rods which extend between said retaining sleeves;

said resiliently flexible rods being substantially circumferentially arranged at said resilient element such as to extend substantially parallel to and at a predetermined clearance from at least part of said housing of the spindle collar bearing;

said resiliently flexible rods being substantially circumferentially arranged at said resilient element at substantially equal circumferential spacing from one another;

a first one of two retaining sleeves being structured to be anchored at said spindle rail; and a second one of the two retaining sleeves being structured to be fixedly anchored at the housing of the spindle collar bearing in a region which is spaced from said predetermined housing side at which said spinning or twisting spindle exits from said housing of the spindle collar bearing.

2. The device as defined in claim 1, wherein:

said resiliently flexible rods are of substantially quadrangular cross-section.

3. The device as defined in claim 1, wherein:

said resiliently flexible rods are made of metal; and each of said resiliently flexible rods has a substantially rectangular cross-section with narrow sides directed substantially radially with respect to said housing of the spindle collar bearing.

4. The device as defined in claim 1, wherein:

said resiliently flexible rods possess a substantially round cross-section.

5. The device as defined in claim 1, wherein:

said retaining sleeves are formed integrally with said resiliently flexible rods.

6. The device as defined in claim 5, wherein:

said integrally formed retaining sleeves and resiliently flexible rods contain substantially oblong, oval intermediate spaces between individual ones of the resiliently flexible rods.

7. The device as defined in claim 1, wherein:

said first retaining sleeve is provided with a flange for anchoring to said spindle rail;

said spindle rail contains an open-ended bore; and said resiliently flexible rods extending from said first retaining sleeve with play through said open-ended bore in said spindle rail.

8. The device as defined in claim 1, wherein:

said housing of the spindle collar bearing contains a lower end; and said second retaining sleeve extending around said lower end of said housing of the spindle collar bearing and at least partially engaging said lower end from below.

9. The device as defined in claim 8, wherein:

said lower end of said housing of the spindle collar bearing and said second retaining sleeve are interconnected by a press fit.

10. The device as defined in claim 1, wherein:

each said resiliently flexible rod defines two ends; and each said resiliently flexible rod is constructed with a cross-section which increases towards said two ends of said resiliently flexible rods.

11. The device as defined in claim 10, wherein:

said resilient element contains substantially oblong, oval intermediate spaces between individual ones of the resiliently flexible rods.

12. The device as defined in claim 1, wherein:

said resilient element contains at least four of said resiliently flexible rods.

13. A device for radially movably mounting at a support a housing of a spindle, said device comprising:

a resilient element for mounting said housing at the support;

said resilient element having two ends;

said resilient element containing a retaining sleeve at each one of its two ends and defining first and second retaining sleeves;

said resilient element further containing a plurality of resiliently flexible rods which extend between said retaining sleeves;

said first retaining sleeve being capable of being anchored at said support; and said second retaining sleeve being structured so as to be capable of being fixedly anchored at the housing of the spindle in spaced relationship to the support.

* * * * *